United States Patent [19]

Snetting

[11] Patent Number: 4,842,432

[45] Date of Patent: Jun. 27, 1989

[54] POWER PAINTING UNIT

[75] Inventor: Mark Snetting, Eden Prairie, Minn.

[73] Assignee: Wagner Spray Tech Corporation, Minneapolis, Minn.

[21] Appl. No.: 204,977

[22] Filed: Jun. 7, 1988

Related U.S. Application Data

[63] Continuation-in-part of Ser. No. 894,889, Aug. 8, 1986, abandoned, and a continuation-in-part of Ser. No. 943,886, Dec. 19, 1986, abandoned.

[51] Int. Cl.[4] ..... B44D 3/28

[52] U.S. Cl. ..... 401/197; 401/146; 401/208

[58] Field of Search ..... 401/197, 146, 149, 150, 401/208; 417/44; 200/83 J; D7/379; 239/331-333, 351, 361; 222/214, 333

[56] References Cited

U.S. PATENT DOCUMENTS

| | | | |
|---|---|---|---|
| 1,727,549 | 9/1929 | Kübler | 239/361 |
| 2,662,666 | 12/1953 | Lamport . | |
| 2,960,040 | 11/1960 | Bischoff . | |
| 3,014,623 | 12/1961 | Horn et al. . | |
| 3,134,130 | 5/1964 | Chadwick II . | |
| 3,195,170 | 7/1965 | Howard . | |
| 3,224,743 | 12/1965 | Freedman et al. | D7/379 |
| 3,230,570 | 1/1966 | Flippen . | |
| 3,305,137 | 2/1967 | Gauthier et al. | 239/333 |
| 3,384,080 | 5/1968 | Muller . | |
| 3,446,238 | 5/1969 | Norstrud et al. | 417/44 |
| 3,457,017 | 7/1969 | Bastian . | |
| 3,591,319 | 3/1969 | Shlisky . | |
| 3,816,035 | 6/1974 | Malbec . | |
| 3,873,790 | 3/1975 | Coons . | |
| 4,072,429 | 2/1978 | Terzian et al. . | |
| 4,168,415 | 9/1979 | Edwards, Jr. et al. | 200/83 J X |
| 4,175,300 | 11/1979 | McGlew et al. | 401/197 |
| 4,217,062 | 8/1980 | Trp et al. . | |
| 4,229,299 | 10/1980 | Savitz et al. . | |
| 4,231,668 | 11/1980 | Groth et al. . | |
| 4,424,011 | 1/1984 | O'Brien et al. . | |
| 4,438,305 | 3/1984 | Johnson | 200/83 J |
| 4,513,885 | 4/1985 | Hogan | 222/214 X |
| 4,540,301 | 9/1985 | Swanson et al. . | |
| 4,588,318 | 5/1986 | O'Brien et al. . | |
| 4,639,156 | 1/1987 | Stern et al. | 401/146 |

FOREIGN PATENT DOCUMENTS

| | | |
|---|---|---|
| 3305657 | 8/1984 | Fed. Rep. of Germany . |

OTHER PUBLICATIONS

Paint Pal sold by Campbell Hausfeld, Manual dated 5/86.

*Primary Examiner*—Richard J. Apley
*Assistant Examiner*—Franklin L. Gubernick

[57] ABSTRACT

A power paint applicating unit includes a horizontal base having a paint pump, an upright member projecting from the base and having manually operable controls, and a horizontal top pivotally connected to the upright member and overlying a portion of the base unit so that standard paint cans fit therebetween. The hinged top member includes an intake dip tube for drawing paint from the paint can and feeding it through a variable pressure shut-off to a paint applicator unit, such as a roller. A rest is provided for the roller in the hinged top which is formed to provide a handle for lifting.

18 Claims, 3 Drawing Sheets

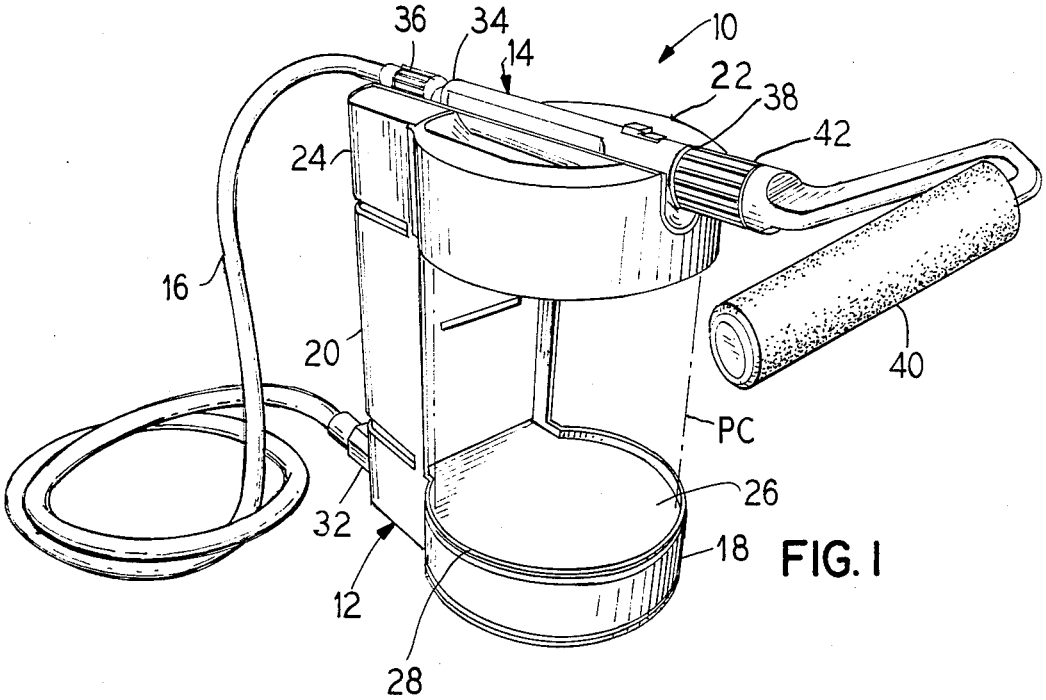
FIG. 1
FIG. 2
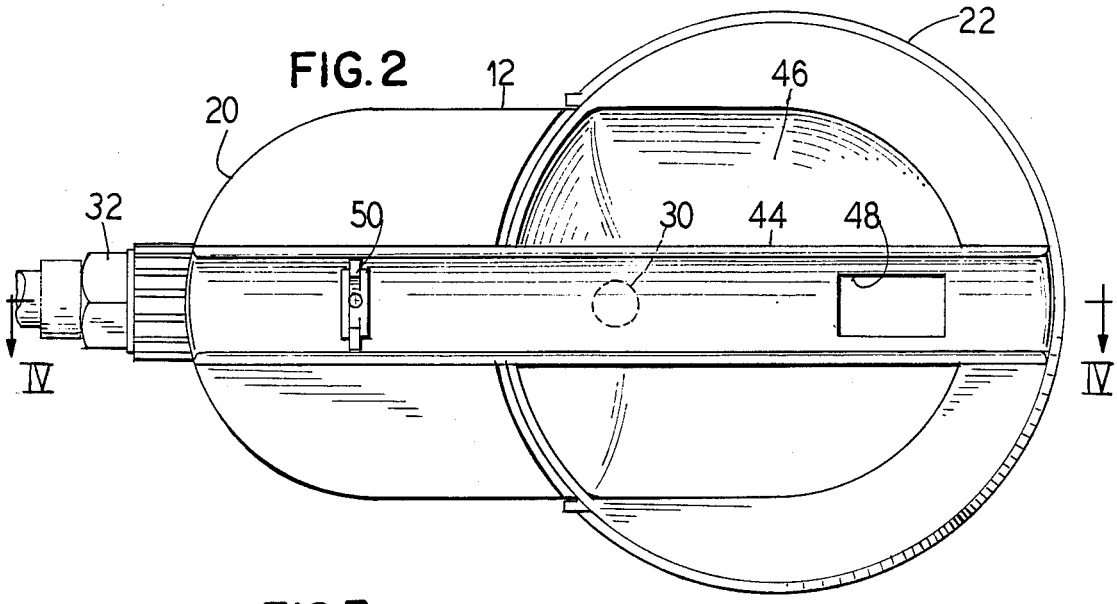
FIG. 3
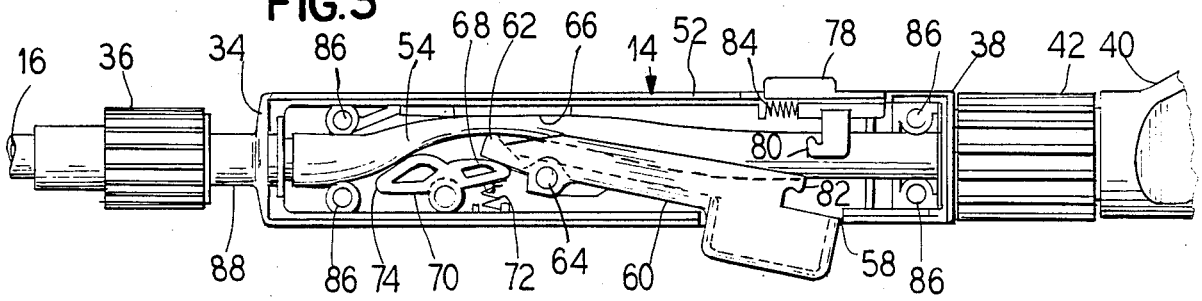

FIG. 4
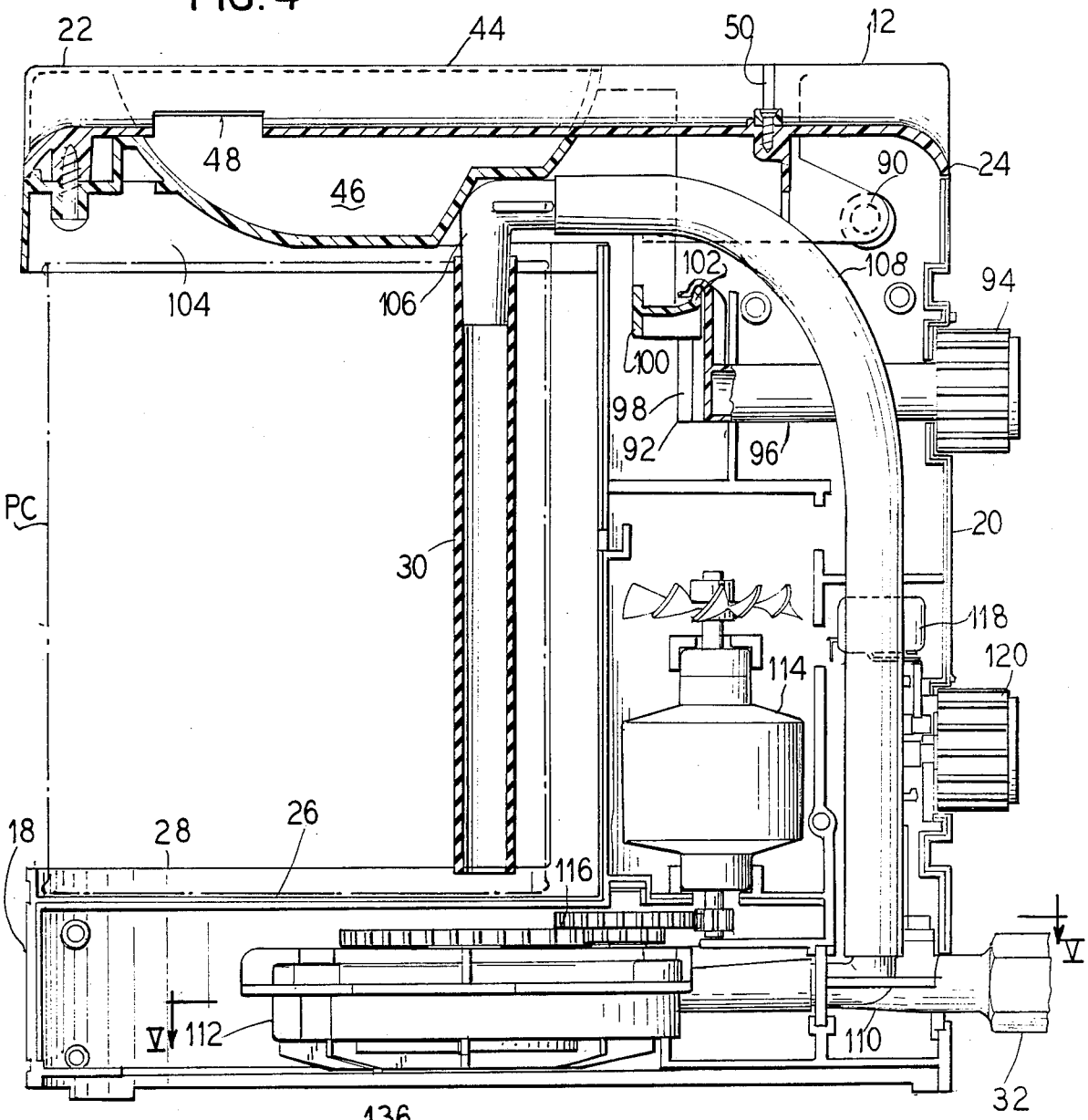
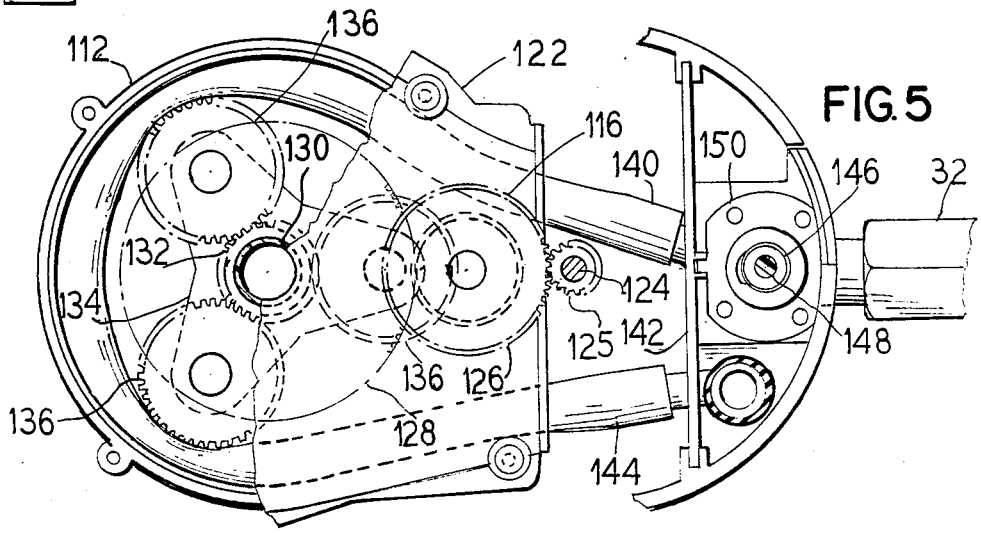
FIG. 5

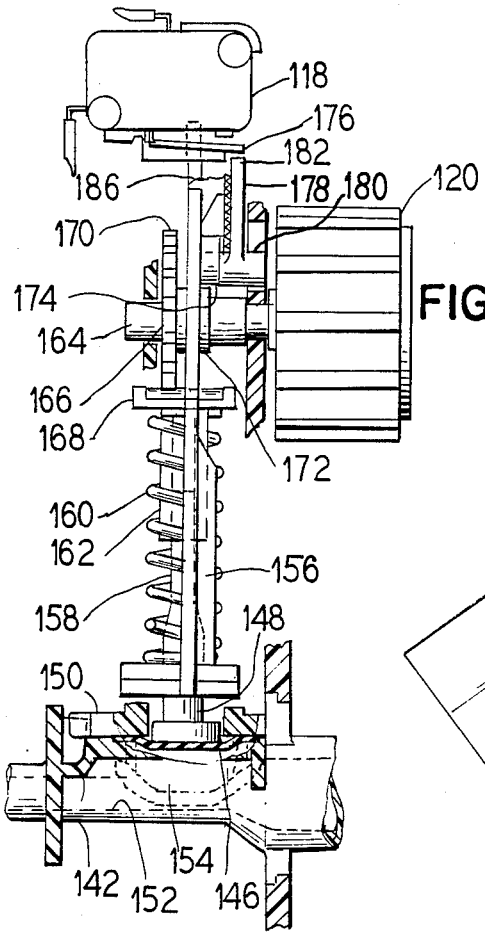
FIG. 6
FIG. 7
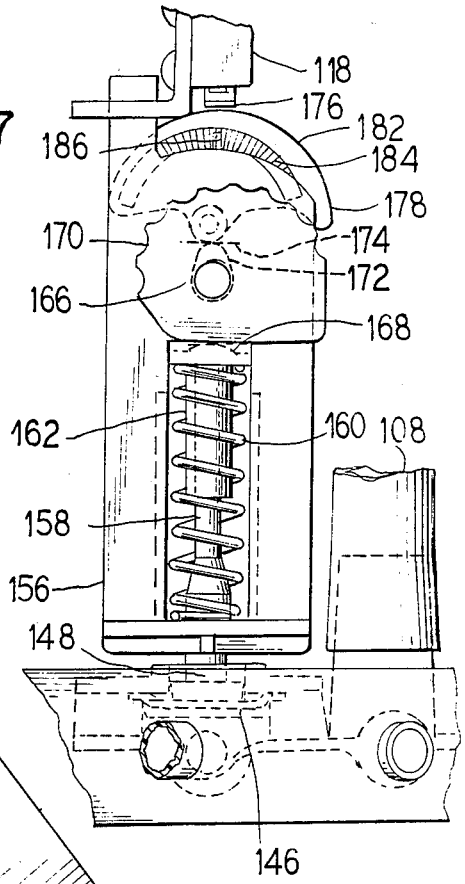
FIG. 8
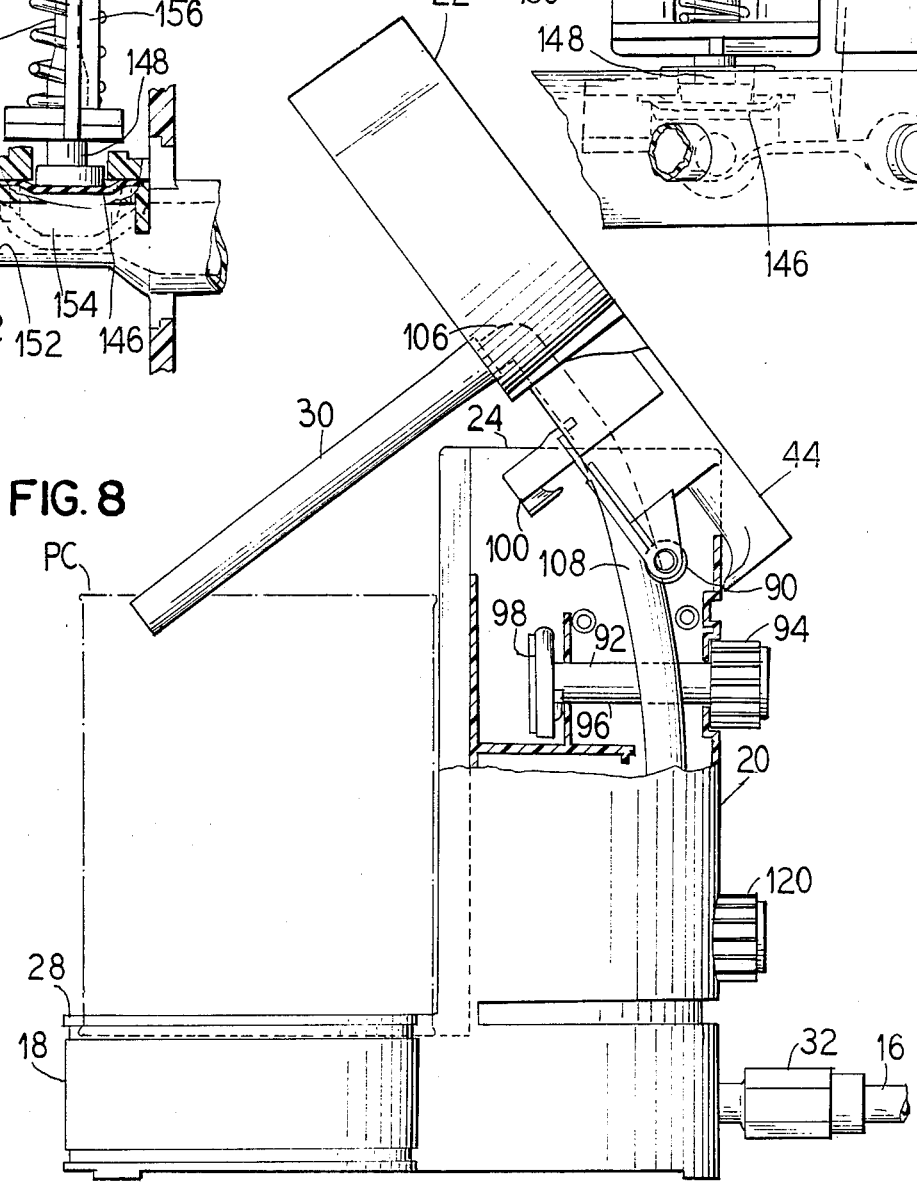

POWER PAINTING UNIT

CROSS-REFERENCE TO RELATED APPLICATION

This is a continuation-in-part of application Ser. No. 894,889, filed Aug. 8, 1986, now abandoned and of application No. 06/943,886, now abandoned, filed 12/19/86.

BACKGROUND OF THE INVENTION

1. Field of the Invention

The present invention relates generally to a power painting unit for supplying paint to a paint applicator from a paint receptacle, such as a paint can.

2. Description of the Prior Art

Power painting units including applicating rollers are known wherein a power unit pumps paint from a paint reservoir through a tube to a roller or the like. In some of the known power painting units, the paint reservoir is pressurized to force paint to the applicator. A problem is presented by the pressurization of the paint reservoir in that the proper pressure seal is difficult to achieve, and that there is a risk of over-pressurization of the reservoir. Furthermore, the paint reservoir must be depressurized prior to changing the paint.

SUMMARY OF THE PRESENT INVENTION

A power painting unit according to the principles of the present invention includes a power base having generally a C configuration within which is mountable a paint reservoir, such as a paint can. The C-shaped power base has a hinged top for easy insertion and removal of the paint reservoir cans, and includes an inlet dip tube mounted for movement with the hinged top so that the inlet tube extends into the reservoir when the top is in a down position and is removed from the paint reservoir when the hinged top is in the up position. The hinged top of the unit is lockable in the down position to ensure proper operation and to prevent paint spillage. The hinged top of the unit includes a convenient rest for a handle portion of a paint applicator, the rest being shaped to function as a carrying handle for the entire power painting unit. The carrying handle allows the powered paint unit to be easily carried from place to place, even when a paint can is mounted therein.

A variable pressure shut-off valve is provided in the unit to prevent excessive pressure build-up, the valve preferably being controlled by a user operable control which also serves as an on/off switch for the power painting unit. Thus, the unit is turned on and off and the pressure regulated with a single control. The on/off and pressure regulation switch controls a suction pump that draws paint from the paint reservoir, eliminating the requirement of pressuring the paint reservoir.

BRIEF DESCRIPTION OF THE DRAWINGS

FIG. 1 is a perspective view of a powered paint applicator unit according to the principles of the present invention;

FIG. 2 is a plan view of the power base portion of the paint applicator unit shown in FIG. 1;

FIG. 3 is a side elevational view of an applicator handle of the applicator unit of FIG. 1, and having a portion of the casing removed therefrom;

FIG. 4 is a cross section of the base portion of the applicator unit along line IV—IV of FIG. 2;

FIG. 5 is a cross section generally along the line V—V of FIG. 4 showing a pump apparatus and a valve of the present invention;

FIG. 6 is a side elevational view of a valve arrangement and power switch of the present paint applicator;

FIG. 7 is a front elevation of the valve arrangement and power switch shown in FIG. 6; and FIG. 8 is a side elevational view, partially in cross section, of the power base portion of the present invention showing the top in an open position.

DESCRIPTION OF THE PREFERRED EMBODIMENTS

Referring first to FIG. 1, a powered paint applicator unit indicated generally at 10 includes a power base 12 and an applicator handle 14 connected thereto by a flexible tube 16. The power base 12 is adapted for receiving a liquid reservoir, such as a paint can PC shown by dotted outline. The power base 12 is formed by three portions, a first, lower portion 18 upon which the paint can PC rests, an upright portion 20 extending vertically from the lower portion 18, and a third top portion 22 projecting laterally over the lower portion 18 from an upper end 24 of the upright portion 20. The lower portion 18 includes a paint can receiving surface 26 at the top thereof with a rim 28 extending substantially therearound and having a diameter slightly larger than that of a standard size paint can. An intake, or dip, tube 30 extends from the top portion 22 downwardly to just above the paint can receiving surface 26.

The flexible tube 16 is connected to the upright portion 20 of the power base 12 by a connector 32, such as a threaded connector. The other end of the flexible tube 16 is connected to a first end 34 of the applicator handle 14 by a second connector 36, which may also be a threaded connector. At an opposite end 38 of the applicator handle 14 is connected a roller attachment 40 by a threaded sleeve or other locking connector 42. Although a roller-type applicator is shown, a variety of other paint applicator attachments are also possible.

The applicator handle 14 is shown resting on the top portion 22 in a recess formed in a combined lift handle and applicator handle rest 44. A trough-shaped recess in the lift handle/rest 44 receives the applicator handle 14 when the applicator 40 is not in use. A recess 46 is provided in the top portion 22 beneath part of the lift handle/rest 44 so that a user's hand may be grasped therearound for lifting and carrying the paint applicator unit 10. Thus, the present applicator unit 10 may be moved about by the conveniently located lift handle/rest 44 while the applicator is resting therein so that only a single hand is required. Furthermore, no additional elements are required for holding the roller attachment 40 when not in use.

In the top view of FIG. 2, the lift handle/rest 44 extends across the top of both the circular top portion 22 and the upright portion 20. The top portion 22 has substantially the same diameter as the lower portion 18 and, thus, covers the top of an open paint can PC placed in the power base 12. A shaped opening 48 in the lift handle/rest 44 receives a trigger of the applicator handle 14, which will be described hereinafter. A semicircular flange 50 is mounted in the trough-shaped lift handle/rest 44 to receive a constricted portion of the applicator handle 14 and, thereby, prevent relative movement. The location of the intake tube 30 extending downwardly from the top portion 22 can be seen in dotted outline, as can the generally oval configuration of the recess 46 for receiving the hand of a user during carrying of the applicator unit 10.

A preferred embodiment of the paint applicator unit 10 includes an applicator handle 14 as shown in FIG. 3. The applicator handle 14 includes a casing 52, a portion of which has been removed to reveal the internal workings thereof. A flexible handle conduit 54 extends along the length of the applicator handle 14 and provides a flow path between the tube 16 and the roller attachment 40 or other paint applicator attachment. In one embodiment, the flexible conduit 54 is covered by a mesh-like covering to provide strength and durability, particularly at a pinched portion thereof.

A trigger 56 extends outwardly through an opening 58 in the casing 52 of the applicator handle 14. The trigger 56 fits into the correspondingly-shaped opening 48 in the lift handle/rest 44 when the applicator handle 14 is placed therein. The trigger 56 is at one end of a pinch lever 60, the other end of which includes a pinch member 62 which is pressed against a portion of the flexible handle conduit 54 to restrict the flow therethrough. The pinch lever 60 is mounted for pivotal movement about a pivot axis 64 within the casing 52. The pinch member 62 presses a portion of the handle conduit 54 against an inner wall 66 of the casing 52, that portion of the inner wall 66 against which the conduit 54 is pressed advantageously being thicker than the rest of the handle casing 52.

Beneath the pinch member 62 is pivotally mounted a beveled cam portion 68 of a dog 70. The beveled cam portion 68 abuts the underside of the pinch member 62 and slides thereon somewhat as the trigger 56 is operated. A compression spring 72 is mounted between the cam portion 68 to bias the pinch member 62 upwardly against the flexible conduit 54. A second portion 74 of the dog 70 abuts the flexible handle conduit 54 for stability, yet does not significantly restrict flow therethrough. As the trigger 56 is operated, the dog 70 pivots about a pivot axis 76 and the pinch member 62 opens and closes the flow path through the handle conduit 54.

A trigger lock 78 is slideably mounted in the handle casing 52 opposite the trigger 56. A hook 80 extending from the trigger lock 78 engages a hook 82 on the trigger 56 when the trigger 56 is operated to an open flow position and the trigger lock 78 is slid into a locking position. A compression spring 84 biases the trigger lock 78 to an unlocked position so that the trigger 56 may be unlocked simply by pressing thereagainst, thereby enabling the spring 84 to slide the trigger lock 78 to the unlocked position. Thus, the trigger lock 78 enables the trigger 56 to be held in an open flow position during painting without being constantly gripped by the user of the present device. Various fastener receiving means 86 are provided in the handle casing 52 to receive fasteners, such as screws (not shown), which hold the two halves of the handle casing 52 together. A constricted portion 88 is provided in the handle 14 to receive the flange 50.

In FIG. 4, a cross section of the power base 12 is shown including the intake tube 30 extending from the top portion 22 to near the bottom of a paint can PC. The top portion 22 is connected to the upper end 24 of the upright portion 20 by a hinge 90. The hinge 90 enables the top portion 22 to be pivoted upwardly for easy insertion and removal of paint cans PC, as will be described more completely in conjunction with FIG. 6.

A locking mechanism indicated generally at 92 holds the top 22 in a closed position for carrying and for securely retaining paint cans PC in the base 12. The locking mechanism 92 is operated by an external, manually operable knob 94. The knob 94 turns a shaft 96 that is connected to an arcuate tang engaging portion 98 that securely engages a depending tang 100 extending downwardly from the top portion 22. The arcuate engaging portion 98 has an inner surface 102 of decreasing radius so that, as the knob 94 is turned in a first direction, the decreasing radius of the inner surface 102 exerts an increasing downward force on the depending tang 100 to hold a paint can PC under the top portion 22 and to lock the top 22 in a closed position for carrying and the like. To release the top 22, the knob 94 is turned in a second, opposite direction until the arcuate engaging portion 98 no longer is over the tang 100. The top 22 may thereafter be pivoted upwardly to an open position. An upper rim 104 is provided around an underside of the top 22 to retain paint cans PC thereunder when the top 22 is locked in the down position and to prevent paint spills.

The intake tube 30 is connected to the top 22 at an elbow 106 mounted therein, which in turn is connected to a flexible connector tube 108 that extends from the top 22, down the upright portion 20 and is connected at a lower end thereof to a valve 110. The valve 110 is connected to a pump 112 which generates a flow of paint, which is forced from the power base 12, through the threaded connector 32 and the flexible tube 16, and to the applicator 40. The pump 112 is driven by a motor 114 through a gear arrangement 116. The operation of the motor 114 is controlled through a microswitch 118 that is operated by turning a control knob 120. The knob 120 enables a user to switch the motor 114 on and off.

The pump 112, which is a peristaltic pump, is shown in more detail in FIG. 5, including a pump housing 122. A drive shaft 124 of the motor 114 is connected by a gear 125 to a concentric gear pair 126, which in turn drives a gear 128. The gear 128 has a shaft portion 130 extending through the pump housing 122 to a centrally disposed internal gear 132. Upper and lower three-armed spiders 134 are freely movable about the shaft 130, each arm of the spiders 134 having mounted thereon a planetary gear 136 in engagement with the gear 132. A flexible pump tube 138 is looped within the pump housing 122 and is pinched thereagainst by the planetary gears 136.

As the motor 114 drives the gear arrangement 116, the internal gear 132 causes the planetary gears 136 to rotate on the ends of the three-armed spider 134 which causes the planetary gears 136 to move in a circle within the pump housing 122. As the planetary gears 136 move within the pump housing 122, they sequentially pinch the pump tube 138 to generate a fluid flow thorugh the pump tube 138.

A portion of the valve 110 can be seen in FIG. 5 connected between an output tube 140 of the pump 112 and the threaded sleeve 32 for connection to the tube 16. The valve 110 includes a valve housing 142 to which are mounted the connector tube 108, the sleeve 32, the pump output tube 140, and an input end 144 of the pump tube 138. In the valve housing 142 is a flexible diaphragm 146 against which is pressed a plunger 148 for movement with the diaphragm 146. The diaphragm 146 is held in place by a diaphragm bracket 150.

The valve 110 is shown in further detail in FIG. 6. A through passage 152 is provided through the valve housing 142 for communication between the pump outlet 140 and the threaded connector 32. The through passage 152 includes a pressure sensing chamber 154, the top of which is formed by the flexible diaphragm 146. As pressure at the output of the pump 112 changes, the diaphragm 146 flexes, causing the plunger 148 to be moved vertically. The plunger 148 extends from the bottom of a valve frame 156, the top of which is adjacent the switch 118 so that vertical movement of the plunger 148 and valve frame 156 operates the switch 118.

With reference to both FIGS. 6 and 7, the frame 156 includes a centrally disposed spindle 158 around which is mounted a compression spring 160 and over which is slideably mounted a vertically movable sleeve 162. Extending through an opening in the valve frame 156 is a shaft 164 mounted in the upright portion 20 for rotation with the knob 120. Mounted for rotation with the knob 120 is a cam 166 which abuts a cam follower 168 on the sleeve 162. In a preferred embodiment, the cam follower 168 includes a ridge and the cam 166 has a scalloped edge 170 engaging the ridged cam follower 168 to provide multiple detents for the knob 120.

As the knob 120 is rotated, the cam 166 vertically moves the sleeve 162 which changes the compression on the spring 160. The compression on the spring 160 determines the amount of downward force which must be overcome by the vertical movement of the diaphragm 146 to operate the switch 118. As the downward pressure on the spring 160 is increased by rotation of the knob 120, greater pressures are required at the output of the pump 112 to operate the switch 118.

A second cam 172 is also provided on the knob shaft 164 which directly engages the valve frame 156 at a portion 174. As the knob 120 is turned to an off position shown in FIG. 7, the cam 172 engages the portion 174 and causes the valve frame 156 to move vertically and thereby operate a switch lever 176 on the micro-switch 118 to turn the motor 114 off. The second cam 172 moves the valve frame 156 irrespective of the compression on the spring 160. When the knob 120 is turned to other than the off position, the second cam 172 is free of the frame 156 so that the frame 156 is able to move under the influence of the diaphragm 146.

Also in a preferred embodiment, a portion of the valve frame 156 which contacts the switch lever 176 is vertically adjustable to compensate for tolerance variations in the various parts which make up the valve control. Vertical adjustment is provided by a spiral cam 178 mounted for rotation at an axis 180 on the valve frame 156. A spiral surface 182 of gradually increasing radius provides contact with the switch lever 176 of the micro-switch 118 so that, as the spiral cam 178 is rotated, more or less vertical movement of the valve frame 156 is required to operate the switch 118.

A regular row of teeth 184 is provided in a semicircular arrangement on the spiral cam 178. The teeth are engaged by a pin 186 extending from the valve frame 156, the cooperative engagement between the pin 186 and the teeth 184 enabling the spiral cam 178 to be set at a desired location and thereafter remain until further adjustment is required.

The valve control knob 120, thus, provides a dual function in that it operates the switch 118 to turn on and off the motor 114 which drives the pump 112, and the knob 120 also controls the pressure at which an automatic shut-off of the pump 112 occurs.

Referring now to FIG. 8, the power base 112 is shown with the top 22 in the open position. A paint can PC rests on the receiving surface 126 of the lower portion 18 and may be easily removed therefrom while the top 22 is up. The intake tube 30 is provided at a location in the top 22 such that it is out of the paint in the paint can PC when the top 22 is in the open position, yet does not encounter the edge of the paint can PC during lifting and lowering of the top 22 and still reaches near the bottom of the can PC for pumping virtually all the paint therefrom.

The full length of the lift handle/rest 44 pivots when the top 22 is moved about the hinge 90 so that the applicator handle 14 can remain resting in the lift handle/rest 44 during movement of the top 22, such as for changing of paint cans PC. The user's hand would generally hold the applicator handle 14 in the rest 44 as the top 22 is being lifted, although the trigger 56 of the applicator handle 14 resting in the opening 48 of the rest 44 as well as the flange 50 engaging the constricted portion 88 of the handle 14 at least help retain the handle 14 in the rest 44. The lock 92 is shown in FIG. 8 in the unlock position with the arcuate engaging portion 98 turned to release the depending tang 100 of the top 22.

Thus, there has been shown and described a powered paint applicator unit for receiving a standard size paint can PC for drawing paint therefrom through the intake tube 30 by the suction generated by the pump 112. The motor 114 which drives the pump 112 is turned on and off by the knob 120, which also is rotated to regulate the pressure of the paint at which the pump 112 is shut-off.

The top 22 of the unit is pivotable upwardly for easy insertion of a full paint can PC in the present unit 10 and for subsequent removal of the paint can PC. When the top 22 is in the closed position, a lock 92 securely holds the top 22 against the paint can PC to prevent spillage and to enable the paint applicator unit 10 and paint can PC to be lifted by the lift handle 44. The lift handle 44 also functions as a rest for the applicator handle 14, the applicator handle 14 preferably including a pinch type flow control valve as disclosed herein.

Although modifications and changes may be suggested by those skilled in the art, it is the intention of the inventor to embody within the patent warranted hereon all changes and modifications as reasonably and properly come within the scope of his contribution to the art.

I claim as my invention:

1. A power member for applying paint, comprising:

a base unit having a base member with a receptacle receiving top surface portion;

an upright member projecting above said base member from adjacent said receiving surface;

a substantially horizontal member supported from said upright member and having a portion overlying said receiving surface in spaced relation thereto and a portion overlying a portion of the upright member, said substantially horizontal member hingedly connected to said upright member and movable between a first position wherein said horizontal top member lies in a plane substantially parallel to a plane of the base unit and a second position wherein the horizontal member does not lie in a plane parallel to the plane of the base member and said portions of the horizontal member being rotatable with respect to the upright member above portions of the upright member, whereby a receptacle received on said receptacle receiving surface will underlie said horizontal member when said top member is in said first position, and said receptacle will be easily partially vertically removable from said unit when said horizontal member is in said second position;

lock means carried by one of said members for selectively locking said horizontal member in said first position;

pump means located substantially in said base member;

an elongated stiff suction tube depending from said horizontal member and projectable into a receptacle on said receptacle receiving surface for drawing material from the receptacle, the hinge connection between said horizontal member and said upright member cooperating with a position of said suction tube with respect to said horizontal member such that movement of said top member from said first position to said second position allows said tube to pivot into and out of a paint container received on the receptacle receiving top surface portion;

means connecting said pump means and said suction tube;

for fluid communication therebetween; and discharge means operatively connected to said pump means for discharging material drawn from the receptacle on said receptacle receiving surface.

2. A power member as claimed in claim 1, further comprising:

a handle in said top member for lifting said unit when said lock means is locking said top member in said first position.

3. A power member as claimed in claim 2, further comprising:

a handle member for said discharge means, said handle member including a shut-off valve means for stopping the flow of material from said discharge means; and wherein said handle in said top member includes a rest adapted for receiving said handle member of said discharge means.

4. A power member as claimed in claim 1, wherein said receptable receiving surface of said base member is spaced from said overlying portion of said substantially horizontal top member to receive a standard paint can.

5. A power member as claimed in claim 1, wherein said suction tube means includes a tube projecting to just above said receptacle receiving surface when said top member is in said first position, and said suction tube means comes out of a receptacle on said receiving surface when said top member is in said second position.

6. A power member as claimed in claim 1, further comprising: a valve connected between said pump means and said discharge means for shutting off said pump means at a selected pressure of the material.

7. A power member as claimed in claim 6, wherein said valve includes:

a valve body having a through passage;

a diaphragm mounted at said valve body and movable in response to changes in the pressure of material in said through passage;

a plunger abutting said diaphragm to transmit movements of said diaphragm; and means for automatically controlling said pump means in response to movements of said diaphragm transmitted by said plunger.

8. A power member as claimed in claim 7, further comprising:

manually operable means for controlling the operation of said pump means, said manually operable means also operable to vary the pressure that causes automatic control of said pump means.

9. A power painting unit for supplying paint to a paint applicator comprising:

a platform having an upper surface for accepting a liquid receptacle;

a vertical portion extending substantially normal to said platform laterally of said upper surface;

a lid hingedly connected to said vertical portion and pivotable between a first position substantially parallel to and disposed over said platform and a second position angularly related to said first position;

means for pumping a liquid from the liquid receptacle comprising a pump motor located in the vertical portion and a pump substantially located in said platform; and a dip tube extending from said lid toward said platform to be received in a liquid receptacle on said upper surface, said dip tube connected to said pumping means to draw liquid from the liquid receptacle during operation of the pumping means, said dip tube being sufficiently rigid to allow the dip tube to extend from the lid substantially perpendicular to the lid when the lid is in the first and second position allowing the dip tube to be received within said liquid receptacle when said lid is in its first position and causing the dip tube to be removed from said liquid receptacle when the lid is moved to the second position;

the lid having portions thereof overlying portions of the vertical portion with the hinge connection between the vertical portion and the lid positioned over the vertical portion, the dip tube extending from the lid at a point on the lid spaced from the hinge, said point overlying the platform, and said dip tube being substantially stiff, whereby when said lid is moved from said first position to said second position, said dip tube is substantially removed from a paint can positioned on said platform with the majority of the dip tube remaining over said platform.

10. A power painting unit as claimed in claim 9, wherein said pumping means includes a peristaltic pump having an input connected to said dip tube and an output for connection to the paint applicator.

11. A power painting unit as claimed in claim 9, further comprising:

a handle formed in a top of said lid; and means for selectively locking said lid in at least said first position.

12. A power painting unit as claimed in claim 9, further comprising:

a switch means for controlling operation of said pumping means; and a pressure responsive valve at an output of said pumping means and connected to said switch means to control operation of said pumping means in response to pressure changes at said output of said pumping means.

13. A power painting unit as claimed in claim 12, wherein said switch means is a user operable switch, and said pressure responsive valve includes a user operable means for varying the pressure at which said valve causes said switch to operate said pumping means.

14. A power painting unit as claimed in claim 13, further comprising:

a rotatable knob extending from said vertical portion for manipulation by a user for rotation about an axis;

first and second can surfaces rotatable about said axis upon rotation of said knob;

a valve frame having a fixed surface engageable by said first can surface, and a movable surface engageable by said second cam surface;

means for biasing said movable surface with respect to said valve frame, means on said valve frame for operating said switch means, means on said valve frame for engaging said diaphragm; and the valve including a diaphragm at an outlet end of said pump means.

15. A power painting unit as claimed in claim 14, further comprising:

means for selectively adjusting a switch operating means.

16. A power painting unit for supplying a liquid to a liquid applicator from a paint can or the like, comprising:

a lower portion having a generally circular top surface for accepting a paint can or the like;

a pump mounted within said lower portion and having an outlet end connectable to a liquid applicator;

a top portion spaced from said lower portion and overlying said top surface of said lower portion, an intermediate portion connecting said lower portion to said top portion, said top portion being hingeably connected to said intermediate portion and pivotable from a first position wherein said top portion is parallel to said lower portion to a second position wherein said top portion is not parallel to the bottom portion;

an intake tube extending from said top portion and extending toward said top surface of said lower portion, said intake tube in fluid communication with said pump and said intake tube being sufficiently rigid so that said intake tube is substantially perpendicular to said top portion whether said top portion is in the first or second position causing said intake tube to be received within a paint can supported on the lower portion when said top portion is in the first position and to be removed from the paint can when the top portion is in the second position;

said hinge connection between said top portion and said intermediate portion overlying a portion of said intermediate portion whereby said top portion has portions thereof overlying said intermediate portion, which portions of said top portion are moved with respect to said intermediate portion upon movement of said top portion from said first position to said second position;

a pressure responsive valve at said outlet end of said pump, including:

a pressure sensing chamber connected between said pump output and the liquid applicator;

a flexible diaphragm forming a flexible wall of said pressure sensing chamber;

a plunger abutting said flexible diaphragm;

a valve frame connected to said plunger and movable in response to movement of said flexible diaphragm; and a switch operable by movement of said valve frame and connected to control operation of said pump.

17. A power painting unit as claimed in claim 16, further comprising:

a spindle coupled to said valve frame;

a compression spring mounted over said spindle;

a sleeve slidably mounted to said spindle and biased by said compression spring with respect to said valve frame; and a user operable cam rotatably mounted in at least one of said intermediate portion and said lower portion and having a cam surface engaging said sleeve to vary compression of said compression spring upon rotation of said cam;

whereby varying of the compression on said compression spring changes the pressure at which said switch is operated.

18. An apparatus to supply paint for a powered painting system, said apparatus comprising:

A. A horizontally extending first housing section providing a horizontal platform to support a paint container at a paint containing area;

B. A vertically aligned second housing section connected to said first housing section and extending upwardly therefrom, said second housing section being spaced laterally from the containing area;

C. A pump motor having a vertical axis of rotation and being positioned in said second housing section, said pump motor having an output shaft extending downwardly from the motor and rotatable about said axis of rotation;

D. Drive gear means operatively connected to the output shaft of the pump motor and comprising a center drive gear rotatable about a vertical center axis;

E. A plurality of pump gears positioned around the drive gear means and in operative engagement therewith, said pump gears arranged to travel in a circular path around said center axis in response to rotation of said drive gear, said pump gears and drive gear being mounted in a common operating plane substantially in said first housing section below said paint containing area, said pump gears and drive gear contained in a separate pump housing having a side wall, said pump housing being positioned substantially in said first housing laterally of said output shaft, a gear train between said output shaft and said drive gear;

F. Said pump housing including a housing wall portion with an interior wall section of said side wall with an inwardly facing circular pressure surface partially surrounding said center axis, said curved pressure surface being positioned interior of said first housing section;

G. A compressible pump tube having an inlet portion, an outlet portion, and an intermediate portion extending along said pressure surface, said pump tube being positioned in said common operating plane between said curved pressure surface and said pump gears so that the pump tube is compressed along its length by the pump gears rotating about said center axis and exerting radial forces outwardly directly to said tube, said pump housing having openings therein through a side wall portion thereof, the pump housing openings providing access to the interior of the pump housing for the pump tube from the second housing section;

H. Said pump housing having openings thereinto through said side wall the pump tube extending into and out of said pump housing from the second housing section through said openings; and I. Said pump tube having inlet and outlet ends located in said second housing section, said outlet end connected to outlet means extending outward from said second housing section, said inlet end connected to tube means extending upwardly interior of said second housing section and extending outward of said second housing section at the top portion thereof, said outlet end connected to a dispensing tube, said dispensing tube exiting the second housing portion adjacent a bottom thereof spaced from the first housing section, said tube means terminating in a substantially vertically aligned suction tube which extends into the paint containment area from a third housing member which overlies the paint containment area and which is hinged to the second housing member by pivot means which allow the suction tube to be pivoted into and out of a standard paint can supported on said horizontal platform by pivoting of the third housing member with respect to the second housing member.

* * * * *